US006298928B1

(12) United States Patent
Penchansky

(10) Patent No.: US 6,298,928 B1
(45) Date of Patent: Oct. 9, 2001

(54) DRILL RIG AND CONSTRUCTION AND CONFIGURATION THEREOF

(76) Inventor: Michael D. Penchansky, 197 Hampton Cir., Jupiter, FL (US) 33458

( * ) Notice: Subject to any disclaimer, the term of this patent is extended or adjusted under 35 U.S.C. 154(b) by 0 days.

(21) Appl. No.: 09/625,449

(22) Filed: Jul. 26, 2000

(51) Int. Cl.[7] ..... E21B 3/02
(52) U.S. Cl. ..... 175/162; 405/232
(58) Field of Search ..... 175/57, 122, 162, 175/220, 171, 19, 20, 170; 173/22, 28, 23, 31, 32, 185–188, 193; 405/229, 232, 244–247, 271

(56) References Cited

U.S. PATENT DOCUMENTS 5,236,054 * 8/1993 Jack et al. ..... 175/57
5,273,124 * 12/1993 Lloyd et al. ..... 175/162
5,733,068 * 3/1998 Reinert, Sr. ..... 405/232
5,746,277 * 5/1998 Howell, Jr. ..... 173/184
5,944,452 * 8/1999 Reinert, Sr. ..... 405/232

* cited by examiner

*Primary Examiner*—Robert E. Pezzuto
(74) *Attorney, Agent, or Firm*—Norman Friedland

(57) ABSTRACT

A drilling rig is constructed into modules for ease of mounting and removing from the bed of a vehicle such as a truck and includes a sled module that horizontally moves the drill fore and aft of the bed, and an integrated boom support tower that includes platens that pivotally mount the boom for storing and deployment. The controls are mounted on the support tower in a convenient location for ease of operating the drill.

10 Claims, 6 Drawing Sheets

DRILL RIG AND CONSTRUCTION AND CONFIGURATION THEREOF

DESCRIPTION

1. Technical Field

This invention relates to drilling rigs intended for use in drilling into the ground and particularly to a drill rig configuration and the construction thereof.

2. Background of the Invention

As is well know by those skilled in this technology that the small drill rigs that are utilized for drilling into the ground in depths of 20–100 feet are typically built from component parts that are added to a truck bed or other type of vehicle. This type of drilling rig is generally used in geothechnical investigations, preliminary site investigations, building pad borings, densities and certification, site improvement, roadway and underground utilities, test pits, excavations, pilings, etc. The units generally comprise a boom, a boom support, a sled that moves rectilinear relative to the truck bed, the gasoline engine, the hydraulics (lines and control levers), the auger that is mounted to the boom and controls for rotating the auger at finite speeds and the other components incidental to this technology. The method in which these units are made is by combining these elements in a step-by step fashion until a satisfactory unit is erected. The drill rig typically is made in much the same way that an item is put together by an erector set, namely, each element is added to the assembly until completed. Typically, for example, the gasoline engine is located in the vicinity and the controls therefor are typically located adjacent thereto. The boom is generally attached to a platen that is attached to the main support structure. The problem with these heretofore known drill rig is that they are is expensive and time consuming to erect. And if a sub-assembly is not located probably or is not structurally sufficient, the unit fails or requires undue amount of maintenance.

I have found that I can obviate these problems enumerated above by building the unit in a modular manner so that the sled is formed as an integral unit and the boom support, control system attached to the boom support are all attached to the sled as an integral unit. This assures that the major components are matched and the structural integrity is achieved prior to being attached to the bed of a truck or other moving vehicle. Moreover, the entire can be removed from the truck bed to free-up the truck so that it can be used for other purposes when the drill rig is not being used.

SUMMARY OF THE INVENTION

An object of this invention is to provide a drill rig that is made in modular sections that can be mounted on the bed of a light truck or other type of vehicle and can easily be removed therefrom.

A feature of this invention is that the boom support is made as an integral unit with the sled of the drill rig and is an integral unit that supports the boom that serves to facilitate the mounting and removal of the boom and the auger for ease of assembly and maintenance thereof.

A still further feature of this invention is the drill rig is configured to include all of the controls for operating the piston engine and power units of the drill rig and is judiciously mounted on one of the faces of the boom support structure.

Another feature of this invention is that its weight is relatively light, its size is relatively compact and it is inexpensive to fabricate and assemble.

The foregoing and other features of the present invention will become more apparent from the following description and accompanying drawings.

These figures merely serve to further clarify and illustrate the present invention and are not intended to limit the scope thereof.

DETAILED DESCRIPTION OF THE INVENTION

While this invention describes in the preferred embodiment the drill rig mounted on the bed of a light haul truck, it will be appreciated that it is contemplated that the drill rig of this invention can be mounted on any type of vehicle that has the space for holding the hardware. As will be understood by those skilled in this technology the hydraulic pistons, motors and controls therefor are all commercially available items and the details thereof will be omitted from this description for the sake of convenience and simplicity.

Figure 3:
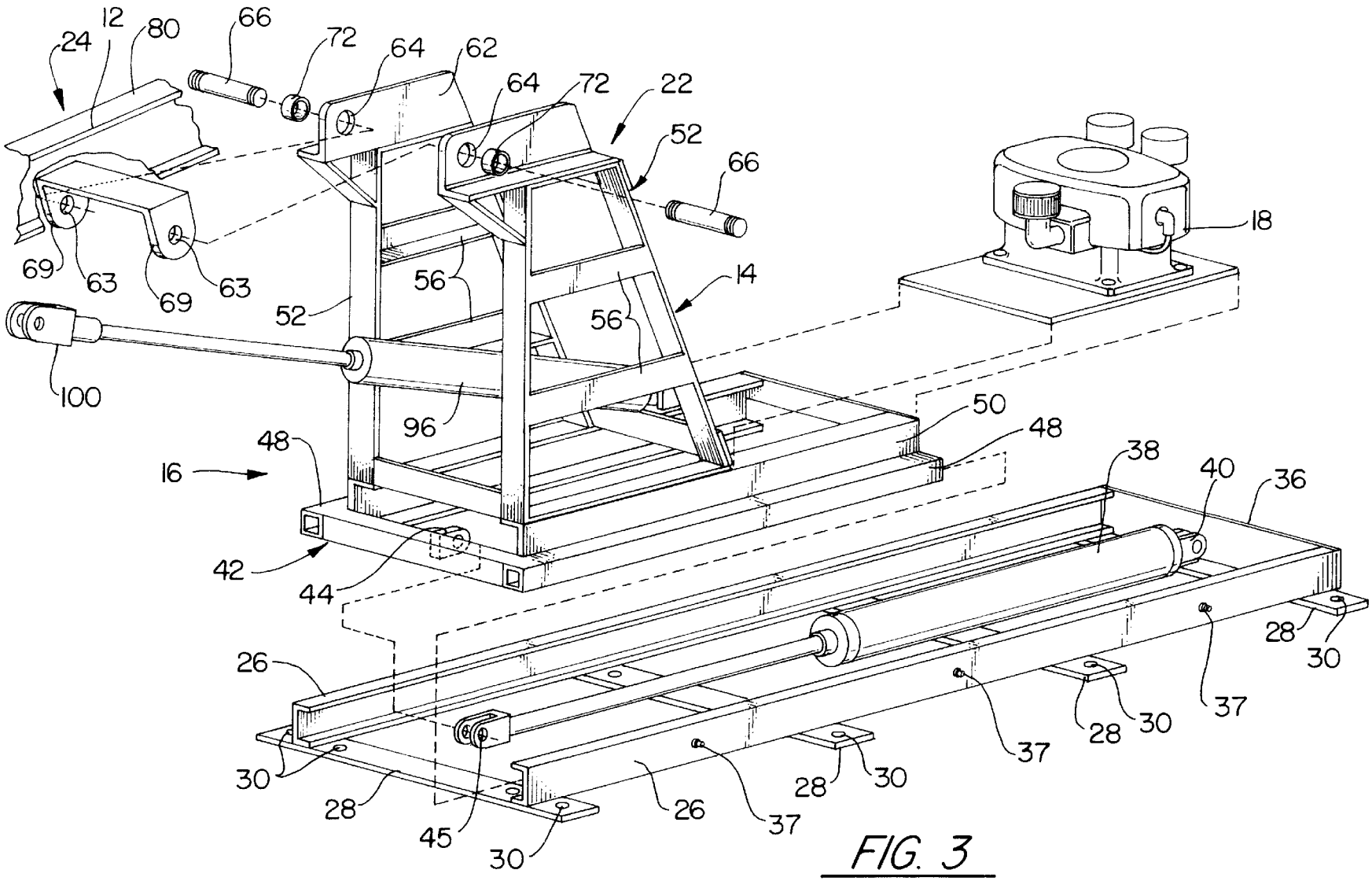
FIG. 3 is an exploded view of the sled module and boom module in perspective illustrating the details of this invention.
Figure 4:
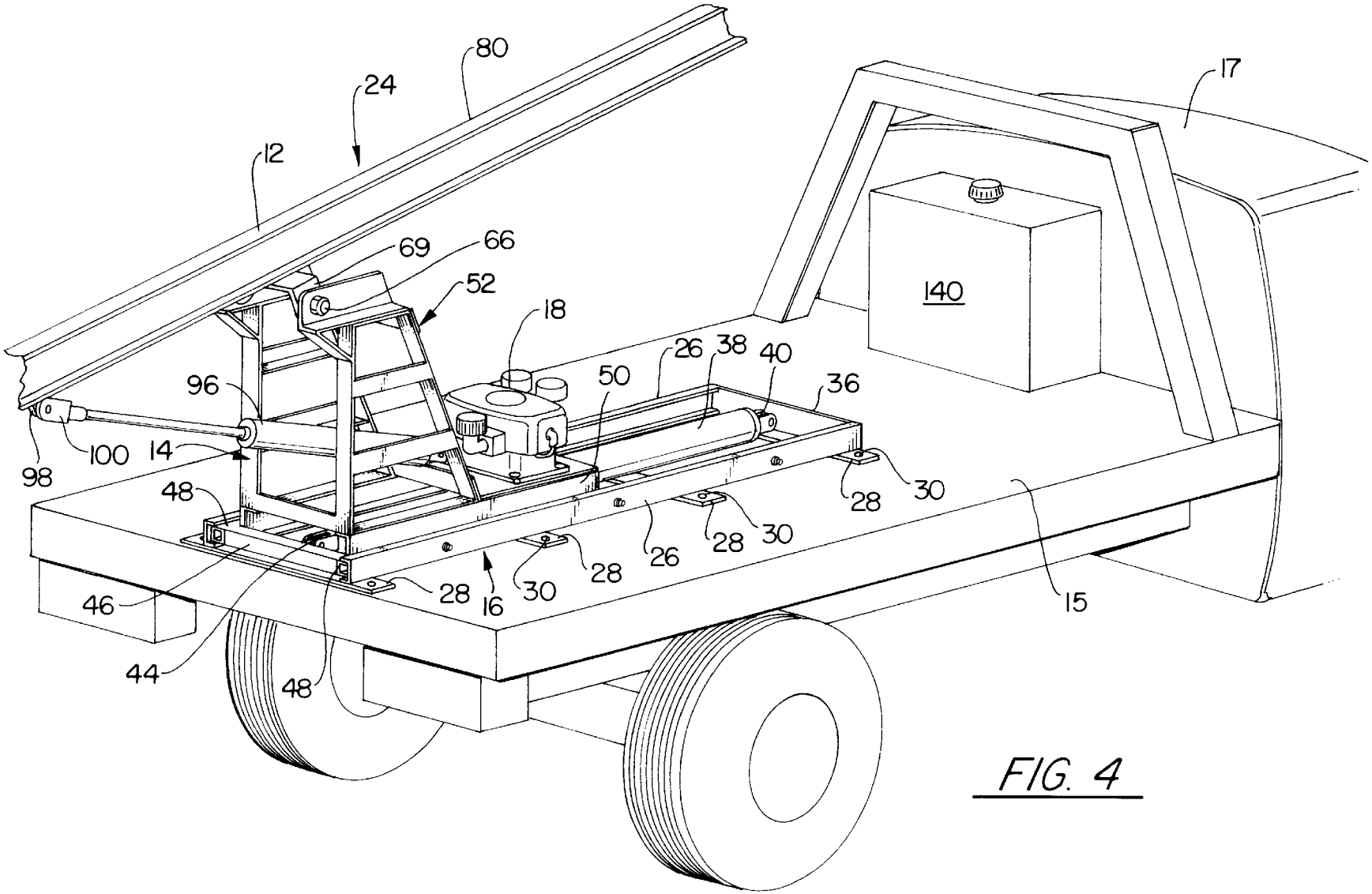
FIG. 4 is a view illustrating the assembled drill rig of this invention mounted on the bed of a truck.
Figure 5:
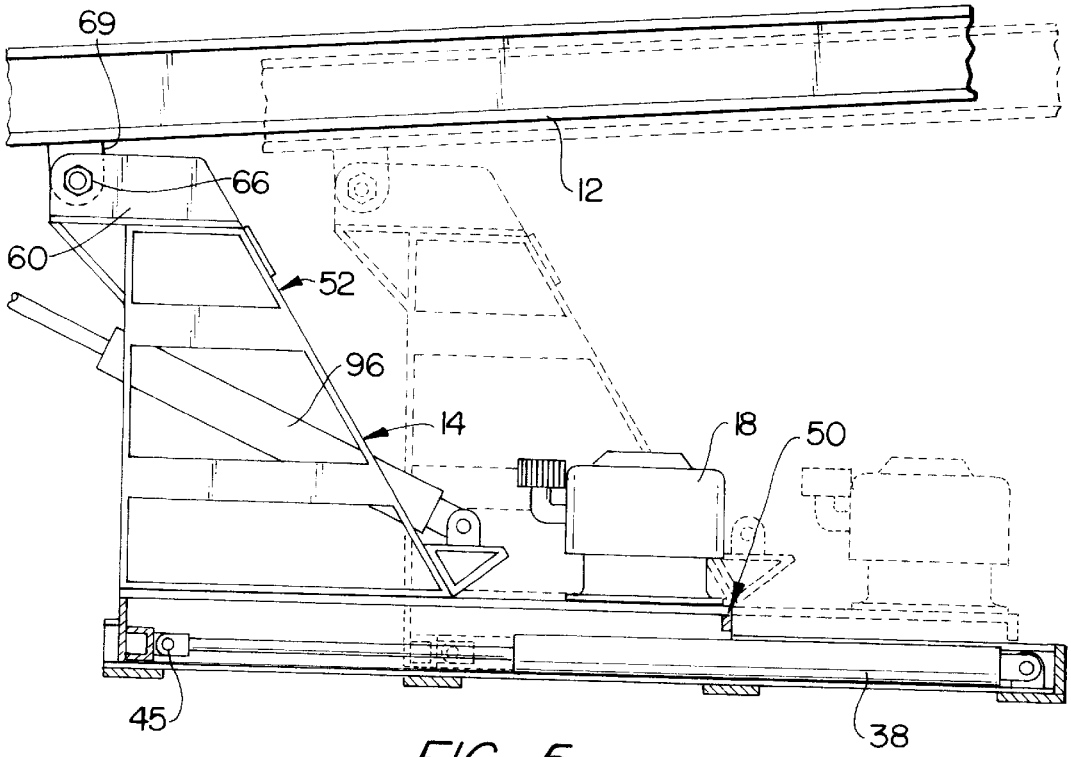
FIG. 5 is a partial view in elevation and schematic illustrating the interface between the boom and the tower support module.

The invention can best be understood by referring to all the figures illustrating the details of this invention comprised of the drilling rig generally indicated by reference numeral 10 having a boom 12 a boom support generally indicated by reference numeral 14 and sled generally indicated by reference numeral 16 mounted on the bed 15 of the light haul truck 17. As best seen in FIGS. 3 and 4, the drilling rig 10 is fabricated in modular construction which consist essentially of the first module 22 consisting of the sled 16, the boom support 14 the gasoline engine 18 and its attendant components hereinafter referred to as the sled module and the second module 24 of the boom 12 and its attendant components herein after referred to as the boom module.

This portion of the description will first describe the sled module and boom module. As seen in FIG. 3 sled includes a pair of C-shaped tracks 26 suitably attached, say by welding, to the cross bars 28 that traverse the tracks 26 and extend beyond. Drilled holes 30 are discretely located in the cross bars and serve to receive suitable nut and bolt assemblies 19 (FIG. 6) that serve to attach the tracks to the bed 15 of the truck 17. A transverse back support bar 36 is suitably attached, say by welding, to the ends of the tracks 26. The hydraulic piston 38 has one end attached to a lug extending from the back bar (not shown) via clevis 40 and the other end is attached to the sliding sled portion 42 that will be described immediately below. As is apparent from the drawings and the foregoing, the tracks 26 are parallelly spaced and serve to support the sled portion 42 for rectilinear movement. Grease mountings 36 are located axially along the tracks to assure that the sled is well lubricated. The opposite end of the hydraulic piston 38 is mounted via clevis 45 to the lug 44 that is suitably attached, say by welding, to the cross bar 46 of the parallelly spaced rails 48 of the sled portion 40. The rails 48, which are rectangularly shaped beams that fit into the channel of the c-shaped tracks 26 for slidable motion and are supported thereby. Obviously, actuating the hydraulic piston 38 serves to move the sled portion 40 fore and aft. (All the hydraulic pistons are similarly mounted using a lug, a clevis and an axle/cotter pin or nut/bolt assembly, which are commercially available and standard fittings).

The boom support 14 consist of a generally box-like three sided frame 50 affixed to the rails 48 that support the tower generally referenced with numeral 52 which, in turn, support the boom as will be described in detail hereinbelow. Tower 52 is formed from a pair of A-frame members 54 having suitable cross brackets 56, the number of which depends on the particular size and weight of the boom. Of importance in the tower 52 is the pair of L-shaped parallelly spaced platens 60 that are integrally formed with the tower and preferably the tower and platens are formed as an integral unit. Each of the platens 60 include an upstanding portion 62 at the top end having drilled holes 64 having a common axis for accepting suitable axles that serve to support the boom for rotary motion. A pair of axles 66 fit into these holes 64 and are held into position by nuts suitably threaded to threads formed at the opposite ends of the axle and serve to support the bifurcated bracket or yoke 68 that is suitably attached to the boom 12 which will be described in more detail herein below. The bifurcated bracket or yoke 68 carries a pair of downwardly extending spaced portions 69 that are dimensioned to fit between the upstanding portions 62 and are disposed so that the outer faces lies adjacent thereto. Complementary holes 63 formed in each of the downwardly projecting portions 69 and have a common axis aligned with the holes 64 when assembled. Bushings 72 are inserted into the holes 64 for supporting the axles 66 to assure that the boom 12 is free to rotate and assume the stored and deployed positions. By virtue of this invention, the boom mounted as described immediately above eliminates the necessity of utilizing ball or roller bearings, which were heretofore required and as consequence reduces the overall cost of the unit, without sacrificing longevity and maintenance of the unit.

Figure 1:
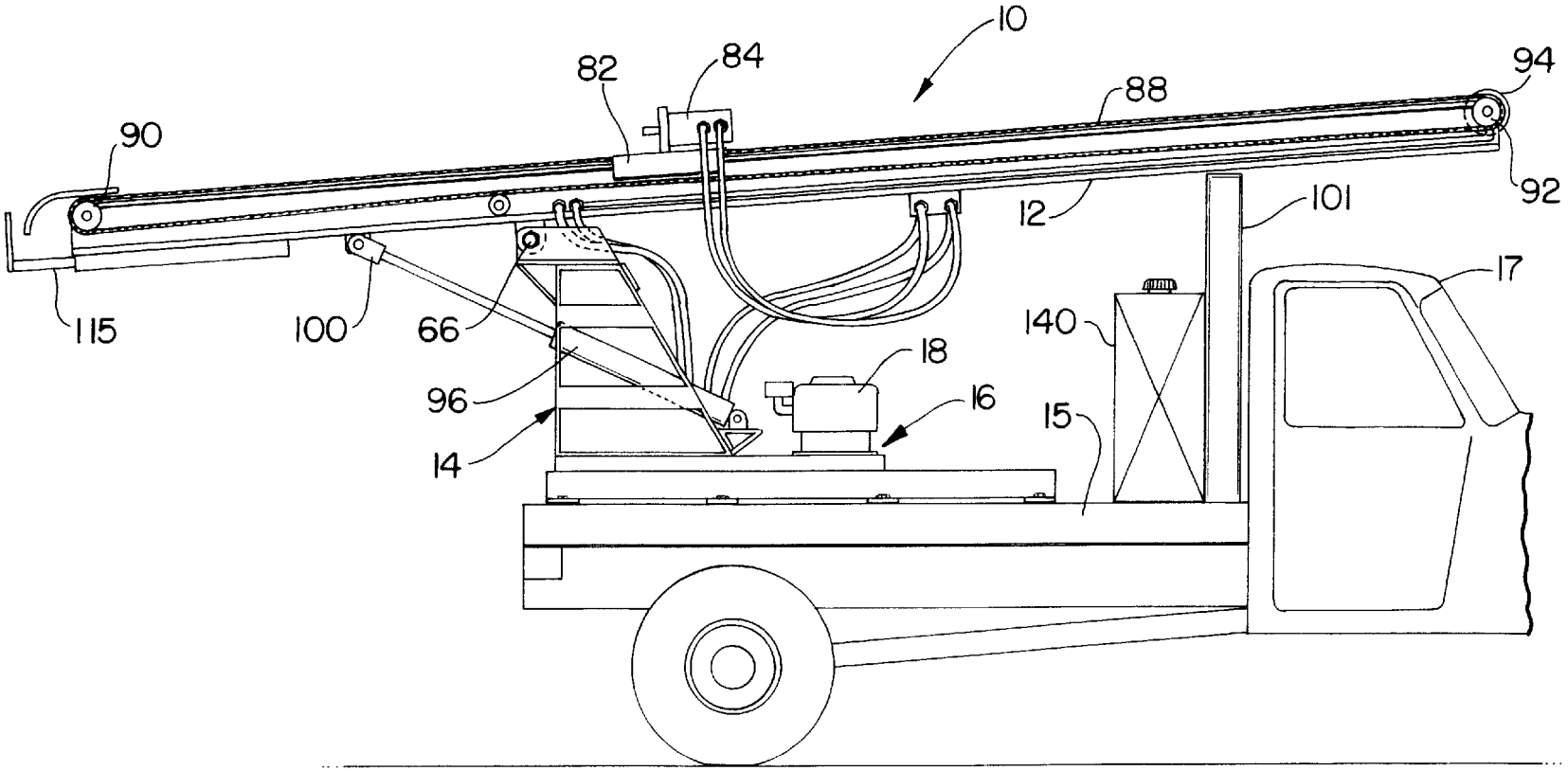
FIG. 1 is a view in elevation and schematic illustrating this invention being mounted in the stored position on the bed of a utility truck.
Figure 2:
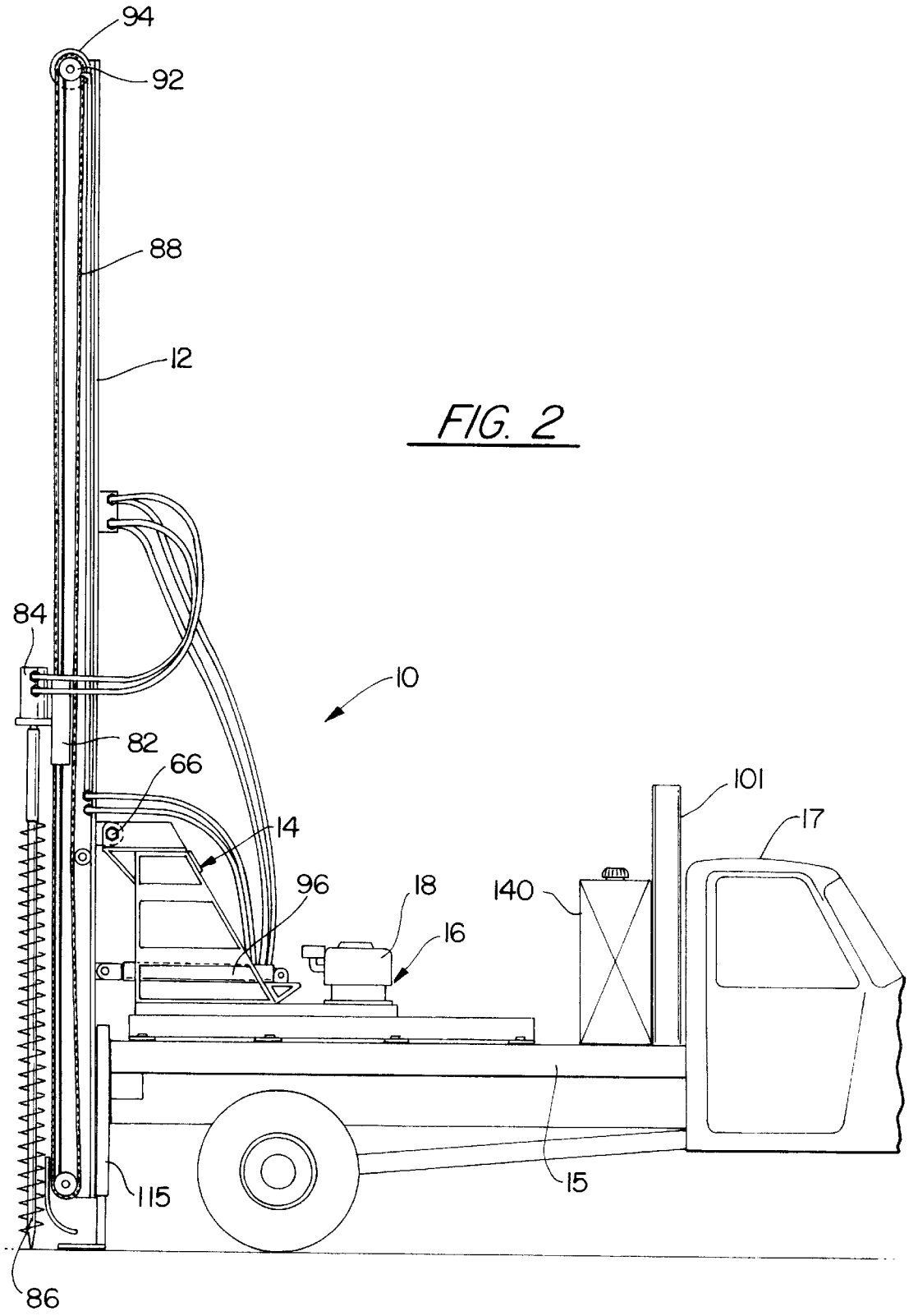
FIG. 2 is a view identical to the view depicted in FIG. 1 with the auger and boom in the deployed position.

As best seen in FIGS. 1, 2 and 3 the boom 12 is fabricated from an H-shaped beam 80 and the outer face 82 defines a flat surface suitably adapted to support the yoke 68 and affixed thereto by a suitable means, such as welding. The boom supports the bracket or drill sled 82 that supports the hydraulic motor 84 which in turn, supports the auger/drill bit 86. The chain 88 that is fitted around the toothed pulleys or sprocket gears 90 and 92 is driven by the hydraulic motor 94 affixed to the top of the boom 12 and serves to raise and lower drill sled 82 which, in turn, raises and lowers the auger/drill bit 86. The hydraulic motor 84 serves to rotate the auger/drill bit 86 and the RPM (revolutions per minute) are finitely adjustable.

The hydraulic piston 96 has one end attached to the bracket 99 suitably affixed to the A-frame boom support and the other end attached to the lug 98 via the clevis 100 for causing the boom to rotate about the axles 66 for deploying the boom and placing it in the stored position. A brace 101 may be included to allow the boom to rest thereon in the stored position.

Figure 6:
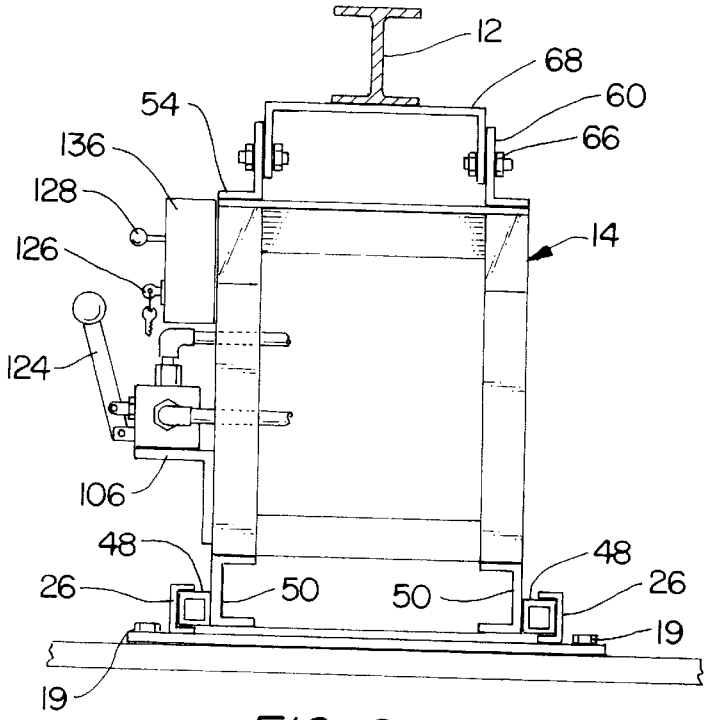
FIG. 6 is an end view of the sled and boom module.
Figure 7:
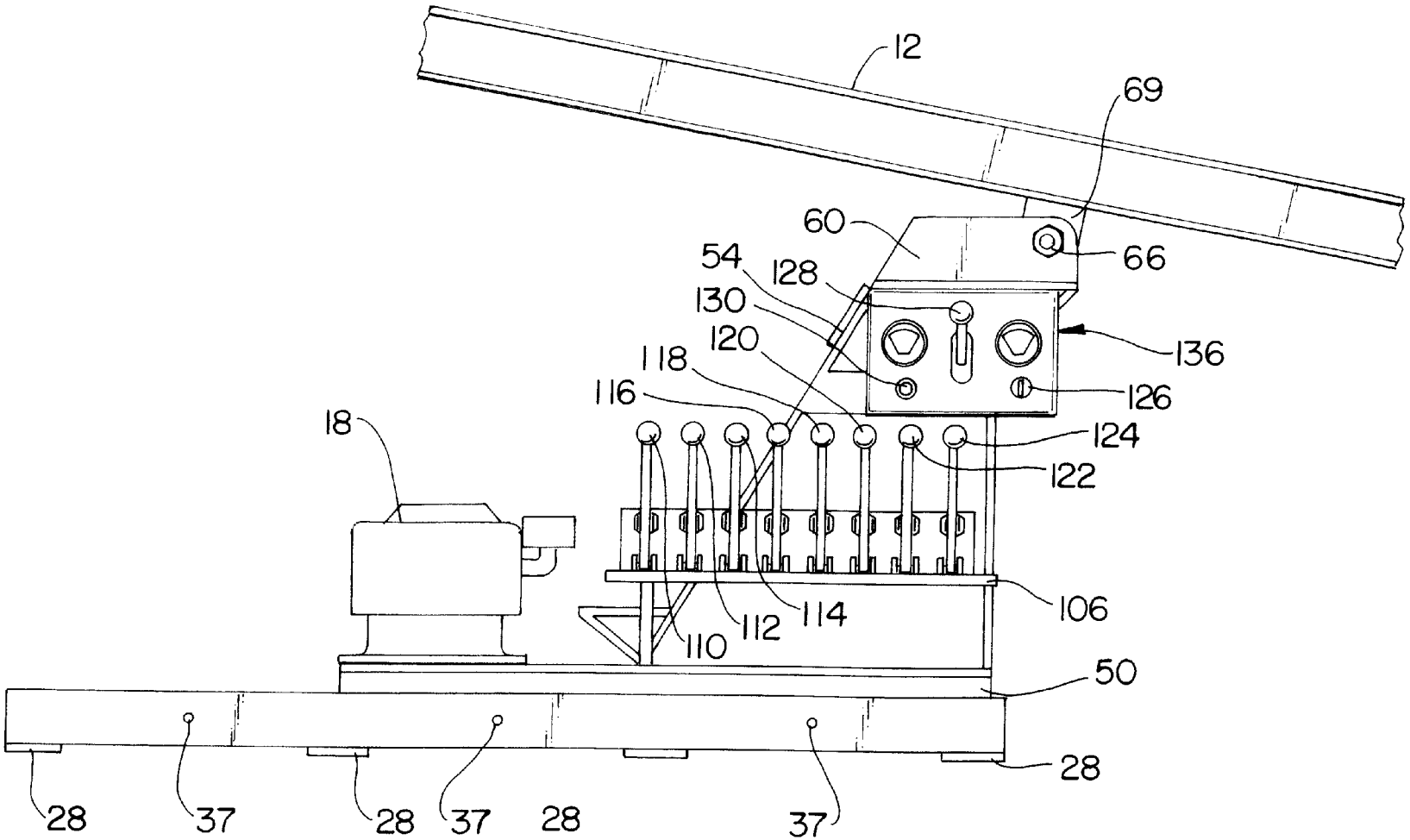
FIG. 7 is a side view illustrating the control panels of this invention.

Another aspect of this invention is that the drill rig is configured so that all the controls are grouped together and supported to the boom support. Since these heretofore known drilling rigs were constructed in piece-meal fashion, the controls for the hydraulic motors, hydraulic pistons and gasoline piston engine would have their individual controls and the controls tended to be located in proximity to the particular machinery being operated. For example, the gasoline piston engine would typically be mounted on the flat bed at any given location and the controls would remain on the engine. In this configuration, because of the modular construction, all the controls lend themselves to be mounted to the boom support 14. As best seen in FIGS. 6 and 7 to this end the shelf 106 is affixed to one side of the A-frame 54 and supports all of the control handles for operating the various power units of the drilling rig. The handles for the various hydraulic units are mounted on the shelf 106, and are configured to allow the operator to conveniently operate the drilling rig. While the number of and location of the control handles are dictated by the particular requirements of the drilling rig, for example the handle 110 serves to operate a well known commercially available cat head (not shown as this is an option that can be utilized with the drilling rig), handle 112 and 114 controls the footer 115 which is also a well known device that lowers to the ground to support the truck bed, handle 116 controls the position of the sled, handles 118 deploys and stores the boom 12, handle 120 controls another footer (not shown), handle 122 controls the up and down position of the drill sled, handle 124 controls the rotational speed of the auger/drill bit.

Also according to this invention the control panel 136 for the gasoline piston engine is likewise mounted to the A-frame 54 for a convenient and efficient location for the operator. The control panels supports the controls for the gasoline piston engine 18 which can be any suitable commercial engine similar to those typically used for lawn mowers or other garden machinery. This panel includes the ignition lock 126, the throttle lever 128, the choke 130 and suitable gauges and lights, as needed.

While not an important aspect of this invention, the hydraulic liquid tank 140 may be mounted to the rear end of the truck bed 15, as shown in FIGS. 1 and 4 and the gasoline tank (not shown) for the gasoline piston engine 18 may be attached to the A-frame 52 of the boom support. In operation the gasoline engine 18 is actuated which, in turn, drives the hydraulic pumps (not shown) for pressurizing the hydraulic fluid lines which is then utilized for powering the hydraulic pistons and the hydraulic motors all of which are well known devices and the details thereof are omitted herefrom for the sake of simplicity and convenience.

What has been shown by this invention is a modular constructed drilling rig that allows for the easy assembly and disassembly of the drilling rig from the supporting moving vehicle, that is characterized as simple and convenient to operate and less costly to construct in comparison to heretofore known drilling rig assemblies. Also, because of the modular construction of the drilling rig, the size, in terms of horse power, of the truck is held to a minimum.

Although this invention has been shown and described with respect to detailed embodiments thereof, it will be appreciated and understood by those skilled in the art that various changes in form and detail thereof may be made without departing from the spirit and scope of the claimed invention.

It is claimed:

1. A drilling rig comprising a first module comprising a frame adapted to be mounted on the bed of a vehicle, said frame having a pair of parallelly spaced tracks, a sled having a pair of rails operatively connected to said tracks for rectilinear movement, a tower supported to said sled, said tower including platens, hydraulic means including control and actuator for positioning said sled, said platens integrally formed at the upper end of said tower, a second module comprising a boom for supporting an auger/drill bit, a yoke attached to said boom and pivotally supported to said platens, and hydraulic means including controls and actuators for positioning said boom, for positioning said auger/drill bit and for rotating said auger/drill bit.

2. A drilling rig as claimed in claim 1 wherein said platens include a pair of upstanding parallelly spaced portions, aligned holes in each of said upstanding parallelly spaced portions, said yoke includes a pair of parallelly spaced downwardly depending portions cooperatively mounted relative to said upstanding parallelly spaced portions and having aligned holes mounted therein, a first axle extending through one of said holes of said upstanding portions and one of said holes in said depending portion and a second axle extending through the other hole of said holes in said depending portion and the other hole of said holes in said upstanding portion for pivotally supporting said boom, and hydraulic means including control and actuator for positioning said boom in a stored and deployed position.

3. A drilling rig as claimed in claim 2 including bushings for rotary supporting said first axle and said second axle.

4. A drilling rig as claimed in claim 1 wherein each of said pair of tracks includes a c-shaped beam, each of said pair of rails includes a square-shaped beam fitted into the channel formed by the c-shaped beam.

5. A drilling rig as claimed in claim 4 including a piston engine mounted on said sled.

6. A drilling rig as claimed in claim 4 including a plurality of cross bars attached to the bottom of said tracks and laterally extending therefrom, fastening means for attaching said cross bars to the bed for ease of assembly and disassembly from said bed.

7. A drilling rig as claimed in claim 6 wherein said tower is configured to include attachments for supporting the controls for all the actuators and pumps and gasoline engine to said tower in a single location.

8. A drilling rig of the type for drilling holes in the ground comprising a sled module comprising a frame adapted to be mounted on the bed of a truck, said frame having a pair of parallelly spaced tracks, each of said pair of tracks includes a c-shaped beam, a plurality of cross bars attached to the bottom of said tracks and laterally extending therefrom and fastening means for attaching said cross bars to said bed, a sled having a pair of rails operatively connected to said tracks for rectilinear movement, each of said pair of rails includes a square-shaped beam fitted into the channel formed by the c-shaped beam, a tower supported to said sled, said tower including a platens, hydraulic means including control and actuator for positioning said sled, said platens integrally formed at the upper end of said tower, a second module comprising a boom for supporting an auger/drill bit, a yoke attached to said boom and pivotally supported to said platens, said platens include a pair of upstanding parallelly spaced portions, aligned holes in each of said upstanding parallelly spaced portions, said yoke includes a pair of parallelly spaced downwardly depending portions cooperatively mounted relative to said upstanding parallelly spaced portions and having aligned holes mounted therein, a first axle extending through one of said holes of said upstanding portions and one of said holes in said depending portion and a second axle extending through the other hole of said aligned holes in said depending portion and the other hole of said aligned holes in said upstanding portion for pivotally supporting said boom, bushings for rotary supporting said first axle and said second axle, and hydraulic means including controls and actuators for positioning said boom in a stored and deployed position, for lowering and raising said auger/drill bit, and for rotating said auger/drill bit.

9. A drilling rig as claimed in claim 8 including a piston engine mounted on said sled.

10. A drilling rig as claimed in claim 8 wherein said tower is configured to include attachments for supporting the controls for all the actuators, pumps and gasoline engine to said tower at a single location.

* * * * *